US005209304A

United States Patent [19]

Nice

[11] Patent Number: 5,209,304

[45] Date of Patent: May 11, 1993

[54] PROPULSION APPARATUS FOR POSITIONING SELECTED TOOLS IN TUBULAR MEMBERS

[75] Inventor: Sidney B. Nice, Humble, Tex.

[73] Assignee: Western Atlas International, Inc., Houston, Tex.

[21] Appl. No.: 745,926

[22] Filed: Aug. 16, 1991

[51] Int. Cl.[5] ..... E21B 23/08; E21B 23/10; E21B 34/10; E21B 45/00

[52] U.S. Cl. ..... 166/383; 166/154; 166/155; 166/202; 166/317; 166/324; 166/385

[58] Field of Search ..... 166/324, 383, 385, 386, 166/202, 317, 321, 322, 154, 155

[56] References Cited

U.S. PATENT DOCUMENTS

| | | | |
|---|---|---|---|
| 2,893,483 | 7/1959 | Copas | 166/202 X |
| 3,070,167 | 12/1962 | Loy III, et al. | 166/153 |
| 3,104,714 | 9/1963 | Terrel et al. | 166/153 |
| 3,381,755 | 5/1968 | Morrison | 166/202 X |
| 4,729,429 | 3/1988 | Wittrisch | 166/383 X |

*Primary Examiner*—Stephen J. Novosad
*Attorney, Agent, or Firm*—Darryl M. Springs

[57] ABSTRACT

A propulsion apparatus is provided for attachment to a selected tool for propelling and positioning the tool in a tubular member in response to fluid pressure in the tubular member and includes a tubular mandrel terminating in a lower free end, a tubular sleeve disposed over the mandrel and adapted for coaxial sliding movement with respect thereto, a cup assembly mounted on the sleeve and cooperating therewith and with the fluid pressure exerted within the tubular member for translating fluid differential pressure developed across the cup assembly into preselected propelling forces, and sleeve retaining means for cooperating with the sleeve and mandrel for positioning and retaining the sleeve in a first position with respect to the mandrel and transmitting the propelling forces to the mandrel and attached tool for propelling and positioning the tool to selected locations within the tubular member. The cup assembly and sleeve retaining means also cooperate to respond to a preselected change in the fluid pressure differential acting across the cup assembly for releasing the sleeve and permitting the sleeve to move from the first position with respect to the mandrel and allow substantial equalization of the differential pressure developed across the cup assembly.

21 Claims, 8 Drawing Sheets

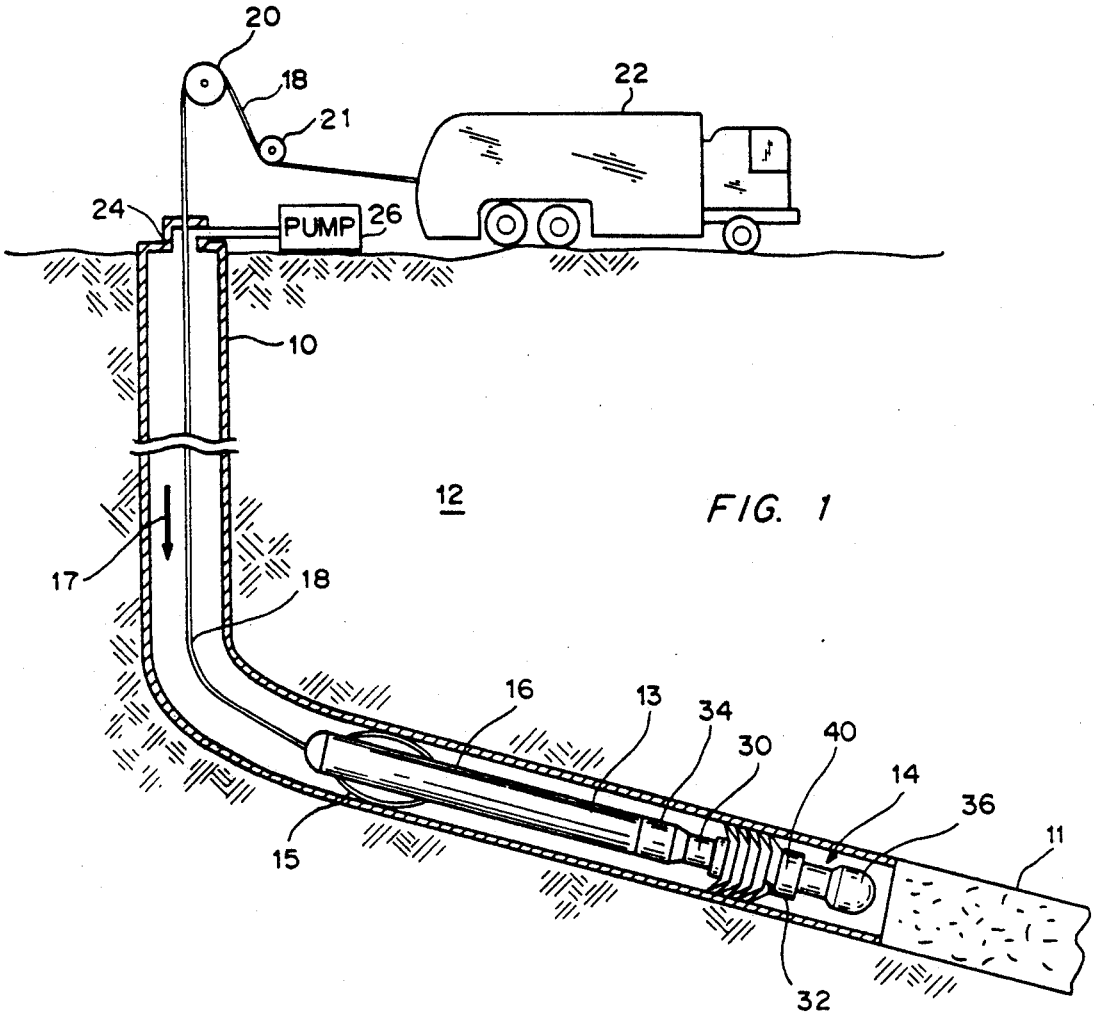
FIG. 1
FIG. 2
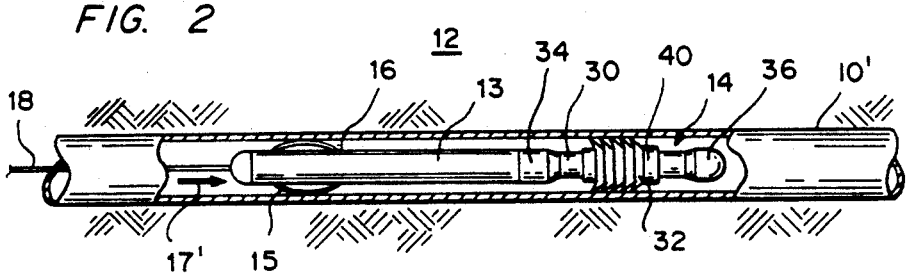

PROPULSION APPARATUS FOR POSITIONING SELECTED TOOLS IN TUBULAR MEMBERS

BACKGROUND OF THE INVENTION

The present invention relates to hydraulically-actuated propulsion devices and more particularly to a propulsion apparatus for use with selected tools to permit insertion and positioning of the tools into borehole tubular members, including well casing and tubing, tubular drill string members or pipeline sections in response to fluid pressure acting on the propulsion apparatus.

Wireline logging and well completion tools are inserted into typical vertical or slightly deviated oil and gas boreholes by gravitational action on the end of a cable (the "wireline") spooled from a drum and winch arrangement on the surface. The wireline tool is lowered into the borehole to a desired depth location and then is raised at a preselected rate during logging operations, or raised or lowered to accomplish other operations. However, in highly deviated or horizontal boreholes, the wireline tool and wireline cable will engage the sides of the borehole walls and the friction between the assembly and the borehole walls prevents continued movement into the borehole.

Similarly, pipeline inspection tools in above-ground or buried pipelines must be "pushed" or "pulled" through the pipeline in order to traverse the length to be inspected. In large diameter pipelines, fluid pressure or air pressure actuated "pigs" or locomotives pull the measurement instruments through the pipeline length to be investigated. In many cases, it is often necessary to have access to each end of the pipeline section to be investigated in order to provide cable systems for pulling the tool through the pipeline section. In extremely long pipeline sections, it would be advantageous to be able to propel and position the inspection tools from one accessible end and then recover the tool from the same end.

Another tool positioning problem in downhole tubular members occurs in drilling deviated wellbores ("directional drilling") using drilling fluid driven drilling motors ("mud motors") that turn the rotary drilling bit on the end of the drill string instead of the entire drill string being driven by a rotary turntable located on the drilling rig. The mud motor is driven by drilling fluid transported downhole through the drill string, i.e., tubular members such as drill pipe and drill collars which make up the drill string. A "steering" tool which controls the direction of drilling of the mud motor is positioned just above the mud motor within the drill string and generally must be properly "aligned" with respect to the mud motor. The steering tool is generally positioned downhole using a wireline cable, which is an expensive and time consuming operation. However, when a well deviation exceeds $\pm 50°$, the positioning of the steering tool can no longer be accomplished by gravity powered methods such as using a wireline cable. Further, it has been difficult to properly "align" the steering tool with the mud motor for a known azimuth direction, and ideally, the mud motor is not operational while the steering tool is being properly positioned.

Accordingly, previously in highly deviated and horizontal oil and gas wells (which are increasing in popularity due to many technological and production advantages over vertical boreholes) wireline tools were not usable and the well logging and completion tools had to be "pushed" or "oonveyed" into the deviated or horizontal borehole by means of tubing strings or flexible coiled tubing pushed down into the borehole. Similarly, in pipelines, certain inspection tools that are available by wireline could not be used unless "pushed" or "pulled" into the pipeline using tubing or by cable if both ends of the pipeline were accessible and the length was not too great. Such tubing conveyed systems are much more expensive to operate than a conventional wireline tool, because of the expense of the great lengths of tubing necessary to insert the tool and because of the expense and complexity of the means necessary to drive the tubing string into the deviated or horizontal borehole or pipeline section and to later retrieve the tubing string.

Accordingly, one feature of the present invention is to provide propulsion apparatus that is fluid actuated for conveying and positioning selected conventional tools in tubular members, especially those that are highly deviated or horizontal.

Another feature of the present invention is to provide a propulsion apparatus that, once hydraulically positioned in the tubular member, responds to a selected fluid pressure change for actuating the propulsion apparatus to allow equalization of the hydraulic pressure acting on the propulsion apparatus.

Still another feature of the present invention is to provide a fluid actuated propulsion apparatus embodiment for conveying and positioning a selected tool within a tubular drill string and permitting fluid above the propulsion apparatus to be discharged through a closed end of the tubular drill string.

SUMMARY OF THE INVENTION

In accordance with a primary principle of the present invention, a propulsion apparatus is provided for attachment to a selected tool for propelling and positioning the tool in a tubular member in response to fluid pressure in the tubular member that includes a top sub portion adapted for connection to the mating end of the tool, an elongated tubular mandrel depending from the top sub portion and terminating in a lower free end, and a tubular sleeve concentrically disposed around the elongated tubular mandrel and adapted for coaxial sliding movement with respect to the mandrel.

Piston means cooperates with the sleeve and the tubular member and fluid pressure exerted therein for translating fluid differential pressure developed across the piston means into preselected forces cooperating with the piston means for applying propelling forces to the sleeve, and sleeve positioning means is provided for cooperating with the sleeve and mandrel and with the propelling force cooperating with the piston means for positioning and retaining the sleeve in a first selected position with respect to the mandrel and transmitting the propelling force cooperating with the piston means and sleeve to the mandrel and the attached tool for propelling and positioning the tool to selected locations within the tubular member. The piston means and sleeve positioning means also cooperate to respond to a preselected change in the fluid pressure differential acting across the piston means for releasing the sleeve from the first selected position with respect to the mandrel and permitting coaxial movement therebetween to substantially equalize the differential pressure developed across the piston means.

The piston means above described can comprise a cup assembly attached to the tubular sleeve and having at least one fin element projecting radially and circumferentially for reducing substantially the annular space between the sleeve and the inner surface of the tubular member with the fluid pressure differential created across the at least one fin element generating the described propelling forces acting on the piston means.

In accordance with one principle of the invention, the tubular mandrel further includes an inner axial bore disposed through at least a portion of the lower length thereof and communicates with the mandrel free end has a port transversely disposed through the mandrel for communicating with the inner axial bore. Cooperating with the transverse ports in the mandrel and the sleeve, the sleeve positioning means may include a plurality of shear pins having a preselected shear resistance radially disposed and circumferentially spaced around the mandrel and cooperating with the sleeve to position and retain the sleeve in a position with respect to the mandrel in which the transverse port disposed in the mandrel is closed for substantially prohibiting fluid communication through the inner axial bore of the mandrel.

In the embodiment above described, the transverse port in the mandrel is opened to fluid communication as a result of a preselected change in the fluid pressure differential acting across the cup assembly attached to the sleeve and which increases the propelling forces acting on the cup assembly and transmitted to the sleeve and shear pins that exceeds the shearing resistance of the shear pins and releases the sleeve for coaxial movement with respect to the mandrel for opening the mandrel's transverse port and diverting the fluid above the cup assembly through the mandrel transverse port and axial bore to equalize the differential pressure across the cup assembly.

In accordance with another principle of the invention, the mandrel does not contain an inner axial bore or a transverse port and the change in the fluid pressure differential acting across the cup assembly attached to the sleeve, and which increases the propelling forces acting on the cup assembly and transmitted to the sleeve and shear pins, that exceeds the shearing resistance of the shear pins releases the sleeve for coaxial movement with respect to the mandrel and disengages from the lower end thereof to equalize the differential pressure across the cup assembly.

In accordance with yet another principle of the invention, the sleeve positioning means may comprise a compression spring acting as a biasing means engaging the mandrel and the sleeve for biasing the sleeve to a position with respect to the mandrel for closing the mandrel transverse port for fluid communication through the mandrel. The differential pressure developed across the cup assembly does not create sufficient forces acting in opposition to the biasing forces of the compression spring to overcome the spring biasing forces, yet provides sufficient propelling forces to position the sleeve and mandrel in the tubular member. However, when the change in the fluid pressure differential acting across the cup assembly attached to the sleeve is increased, the forces acting on the cup assembly overcome the biasing forces exerted by the compression spring and allow the compression spring to move the sleeve to a position with respect to the mandrel for opening the transverse port for fluid communication therethrough.

In accordance with still another principle of the invention, the tubular member comprises a tubular drill string which has a closed lower end with an axial bore therethrough, and the apparatus further includes coupling means cooperating with the closed lower end of the tubular member and the closed end axial bore and the lower free end of the mandrel for permitting latching engagement between the lower free end of the mandrel and the closed end of the drill string and permitting fluid communication between fluid in the drill string above the cup assembly through the mandrel transverse port and axial bore and the drill string closed end axial bore. The coupling means may also include a probe element projecting coaxially from the lower free end of the mandrel and having an axial bore therethrough, for permitting fluid communication from the mandrel axial bore, and engaging means disposed in the closed end of the downhole drill string cooperating with the probe element and the axial bore through the drill string closed end for engaging and latching the probe element with respect to the drill string closed end and permitting fluid communication through the mandrel transverse port and axial bore and the drill string closed end axial bore.

The engaging means may comprise a guide member mounted on the drill string lower end for contacting the probe element attached to the lower end of the mandrel and guiding the probe element into proper orientation for fluid communication with the axial bore in the drill string closed end, and latching means for engaging the probe element and removably latching the probe element to the drill string closed end in fluid communication with the axial bore disposed in the closed end.

BRIEF DESCRIPTION OF THE DRAWINGS

In order that the manner in which the above-recited principles and features of the invention are attained can be understood in detail, a more particular description of the invention may be had by reference to specific embodiments thereof which are illustrated in the accompanying drawings, which drawings form a part of this specification.

In the drawings:

FIG. 1 illustrates the propulsion apparatus according to this invention attached to a selected tool for positioning the tool in a typical highly deviated or horizontal wellbore.

FIG. 2 illustrates the propulsion apparatus according to this invention attached to a selected tool for positioning the tool in a typical pipeline segment.

DETAILED DESCRIPTION OF THE PREFERRED EMBODIMENT

Figure 3A:
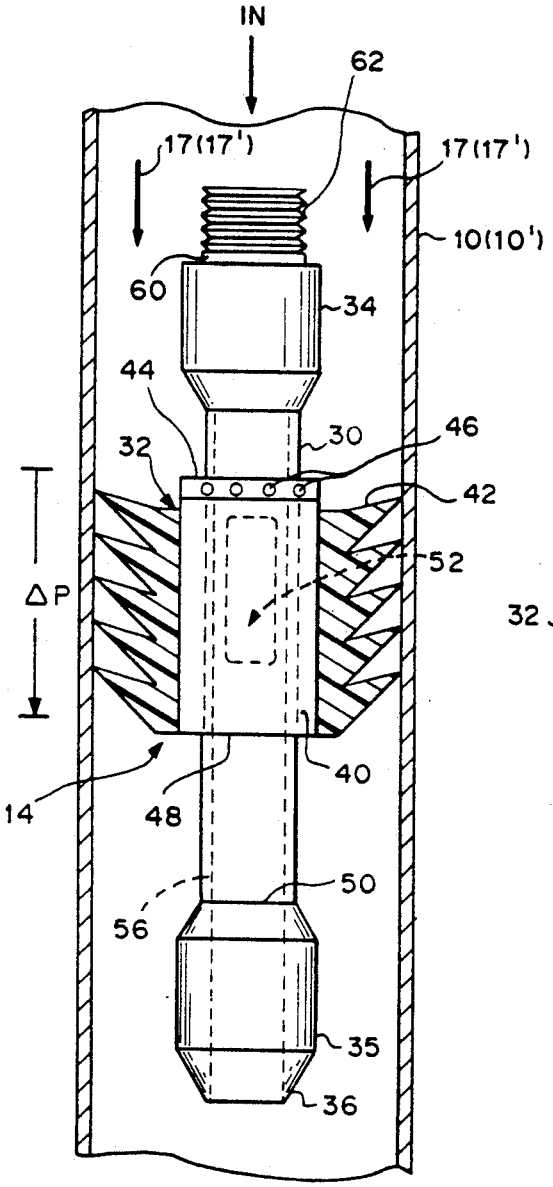
FIG. 3A is a detailed side view, partly in cross-section, showing one embodiment of the propulsion apparatus disposed in a tubular member with the sleeve held by shear pins, closing the axial bore through the mandrel to fluid communication.

Referring now to FIG. 1, a deviated borehole 11 is shown drilled in earth formation 12. A substantial portion of the borehole 11 has been set in steel casing 10, which forms an elongated tubular member closed at the earth's surface by a wellhead 24. The propulsion apparatus 14 according to this invention is shown disposed in the borehole casing 10 and comprises a top sub portion 34, an elongated tubular mandrel 30 having a free end 36, a sleeve 40 and a piston means 32 cooperating with the sleeve 40 as will hereinafter be further described. The top sub portion 34 is threadably and removably connected to the downhole end of a selected tool 16 which is maintained in substantial central axial alignment in the casing 16 by means of conventional centralizers 15. The tool 16 may be a wireline logging instrument or combination of logging instruments or other wireline tools or perforating guns that define the selected tool package 16. The wireline tool 16 and attached propulsion apparatus 14 are suspended in the borehole casing 10 by means of a steel cable 18 (the "wireline") that acts both as a support cable and provides for control and data signal communication between the selected tool 16 and surface electronics and recording apparatus disposed in the recording station truck 22. The cable 18 is supported by sheaves 20 and 21 and dispensed and taken up on a conventional rotating drum (not shown) associated with the recording truck 22. The truck station 22 contains necessary electronic control, transmitting and receiving equipment and display and recording equipment for controlling and monitoring the operation of the tool or tool combination 16 and the propulsion apparatus 14. The length of the cable attached to the tool 16 and apparatus 14 (i.e., the depth of the tool apparatus/ combination 11/14) is conventionally measured by the rotation of the sheave 20 by means not shown. A fluid pump 26 is interconnected through the wellhead 24 to the borehole casing 10 in a conventional manner in order to pump pressurized fluid in the direction shown by arrows 17, such as water or oil, into the tubular borehole casing 10 to provide a fluid differential pressure acting across the piston means 32 that is translated into fluid propelling forces acting coaxially on the piston means to propel the propulsion apparatus and attached selected tool downhole in a manner to be hereinafter further described.

FIG. 2 shows another application of the propulsion apparatus 14 as used in a tubular section of a buried pipeline 10', although the application would be identical in an above-ground pipeline situation. As shown, the propulsion apparatus 14 is identical to that above described in FIG. 1, comprising top sub portion 34, mandrel 30, sleeve 40, piston means 32 and mandrel free end 36 are disposed in the pipeline and attached to the downstream end of the pipeline inspection tool 16' (or other inspection and/or evaluation and/or intervention tool) carrying conventional centralizers, such as the centralizers 15 shown. The tool may be attached to a wireline cable 18 for moving the tool 16' during the tool operation after the propulsion apparatus has initially positioned the tool to a desired starting/working location. In a pipeline application either hydraulic or air pressure may be utilized to move the propulsion apparatus 14 within pipeline 10'. Accordingly, as hereinafter used, the term "fluid pressure" shall include pressure caused by hydraulic pressure of liquids or a by air pressure caused by compressed air or gases.

Referring now to FIGS. 1, 2, 3A and 3B, a first embodiment of the propulsion apparatus 14 will now be described in detail. As previously described, the propulsion apparatus 14 basically comprises a top sub portion 34 having a male threaded connector 62 and a sealing 0-ring 60 for mating with the free threaded box end of the selected tool or tool combination 16(16') (not shown). An elongated tubular mandrel section 30 integrally depends from or is welded to the top sub portion 34 and has an interior axial bore 56. A transverse port 52 is provided for communication with the axial bore 56. A cylindrical sleeve 40 is coaxially disposed over the tubular mandrel 30 and is sized for a close sliding fit over the mandrel. The top end of the sleeve 44 carries therein a plurality of circumferentially spaced and radially disposed apertures 46 that are aligned with a matching set of circumferentially spaced and radially disposed apertures 46' in the mandrel. In the embodiment shown, shear pins or screws (not shown for simplicity) would be inserted in the aligned circumferentially disposed apertures 46/46' to provide some total predetermined shearing resistance and to position and retain the sleeve 40 in a first position shown in FIG. 3A that closes the transverse port 52 and substantially prohibits fluid communication from the interior of the tubular member (10, 10') through the transverse port 52 and axial bore 56 for purposes to be hereinafter described in greater detail. The lower free end 36 of the mandrel 30 has an enlarged portion 35 that provides a circumferential shoulder 50. Shoulder 50 engages the lower edge 48 of the sleeve 40 for limiting the downward coaxial sliding movement of the sleeve 40 with respect to the mandrel 30 as more particularly shown in FIG. 3B.

A cup assembly 32 that also functions as piston mean 32 is mounted circumferentially of sleeve 40. The cup assembly 32 may comprise one or more fin elements 42 that project radially and circumferentially from the sleeve 40 and substantially reduce the annular space between the sleeve and the inner surface of the tubular member 10(10'). The projecting fin element(s) 42 of the cup assembly act as piston means 32 that cooperates with the sleeve 40 and the tubular casing walls 10(10') for translating fluid pressure applied at 17(17'), and developed as a differential pressure across the cup assembly 32, into propelling forces acting on the cup assembly/piston means 32 and transferred to the attached sleeve 40. The propelling forces are controlled by the pressurized fluid forces exerted at 17(17') by the pump 26 for achieving a preselected force magnitude and generally act coaxially to the apparatus 14 and cup assembly/piston means 32 in the direction of the arrows 17(17').

In operation, the propulsion apparatus 14 is attached by the threaded end 62 of the top sub 34 to the lower box end 13 of the tool 16(16') (see FIGS. 1 and 2) and the tool and propulsion apparatus are inserted into the tubular member 10(10'). The sleeve 40 and cup assembly/piston means 32 has been positioned as shown in FIG. 3A with the sleeve 40 covering the transverse mandrel port 52 in order to substantially prohibit fluid flow from the interior of the tubular casing/pipe 10(10') through the port 52 and the axial bore 56 disposed in mandrel 30 and communicating with the free end 36 thereof. A plurality of shear pins (not shown for simplicity) have been inserted into the registering apertures 46 and 46' of the sleeve and mandrel, respectively, to position and retain the sleeve in position shown in FIG. 3A closing the mandrel transverse port as above described.

The pressurized fluid introduced in the casing/pipe 10(10') acts in the direction of the arrows 17(17') to develop a fluid pressure differential "ΔP" across the cup assembly/piston means 32 in the direction shown. The developed pressure differential ΔP is translated into forces having a preselected first magnitude and acting generally coaxially on the fin elements 42 to apply propelling forces to the cup assembly/piston means 32 in the direction of the arrows 17(17') in order to exert the propelling forces on the attached sleeve 40. As long as the propelling forces created by the differential pressure ΔP are of a first magnitude that is less than the combined preselected shear resistance forces of the shear pins disposed in the registering apertures 46 and 46', the shear pins will hold the sleeve 40 in the first selected position closing the mandrel transverse port 52 as shown in FIG. 3A and will transfer the propelling forces acting on the cup assembly and sleeve to the mandrel 30 and the tool 16(16'). Accordingly, the propulsion apparatus 14 will respond to the differential pressure ΔP and translate the fluid differential pressure into coaxial forces acting to push the piston means 32 through the tubular member 10(10') in the direction of reduced fluid pressure, thus acting as a locomotive to "pull" the selected tool string 16(16') through the tubular member to a desired location.

It is not necessary that the radial tips of the fin elements 42 of the cup assembly 32 actually "touch" and/or form a "seal" with the interior of the walls of casing/pipe 10(10'). However, it is necessary that the fins extend radially outward by a sufficient amount to substantially reduce the annular space between the tips of the fins and the inner surface of the tubular member 10(10') in order to prevent any substantial amount of fluid to bypass the fin elements 42 of the cup assembly/piston means 32 and insure that a sufficient pressure differential can be developed and maintained.

When the apparatus 14 and attached tool string 16(16') has been properly positioned, the logging sequence using the tool 16(16') can begin. Typically, logging measurements are taken as the logging tool or instrument 16(16') is raised. Logging speeds are relatively slow and usually the logging tool 16(16') may be raised with the piston means (cup assembly) 32 in the position shown in FIG. 3A, since as above described, there is not necessarily a "seal" between the tips of fins 42 and the inner surface of the walls of the tubular member 10(10'). As long as the tool 16(16') is raised at a rate that permits sufficient "flow" or "leakage" of the fluid past the tips of fins 4 and does not generate sufficient forces to create a ΔP that will exceed the shearing resistance of the shear pins disposed in aligned apertures 46/46', the sleeve 40 will remain in position on the mandrel 30 closing the port 52 as shown in FIG. 3A.

Figure 3B:
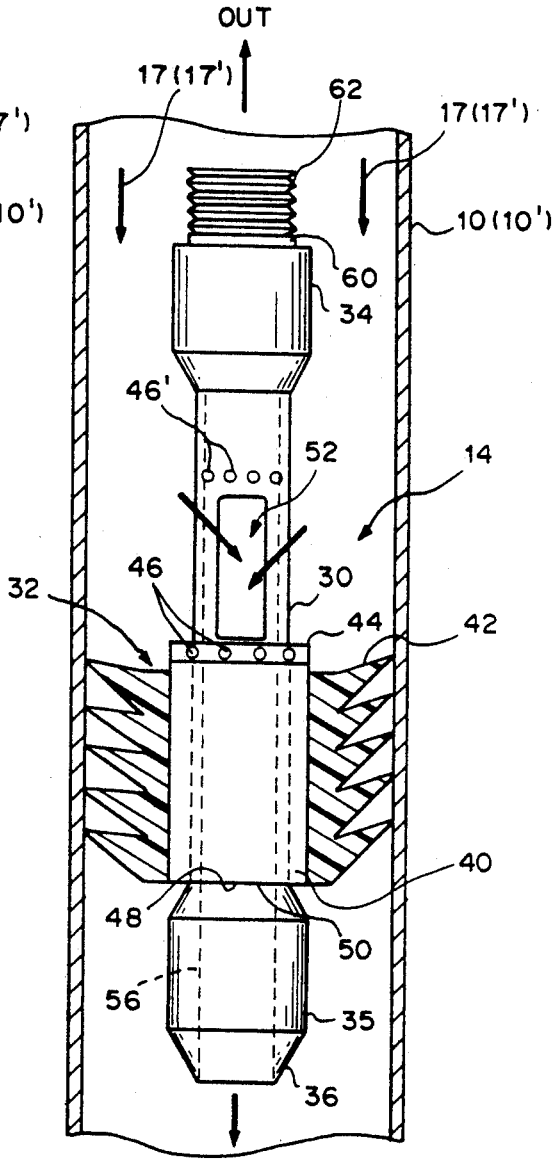
FIG. 3B is a detailed side view, partly in cross-section, showing the embodiment of the propulsion apparatus disclosed in FIG. 3A with the shear pins having been sheared and the sleeve displaced on the mandrel to open the axial bore through the mandrel to fluid communication.

However, if it is necessary to release the sleeve 40 to achieve the correct logging speed of tool 16(16'), or after logging it is desired to rapidly remove to tool 16(16') and the apparatus 14, then the sleeve 40 can be actuated to the position shown in FIG. 3B. The sleeve 40 can be released with respect to the mandrel from a position closing the part 52 to fluid communication as shown in FIG. 3B by one of the following described techniques.

The fluid pressure in the tubular member 10(10') as reflected by arrows 17(17') may be changed by a preselected magnitude (in this embodiment, "raised") to create a ΔP acting across the cup assembly that creates forces sufficient to exceed the shearing forces of the shear pins disposed in aligned apertures 46/46', thus shearing the pins and releasing sleeve 40. The forces at acting on the cup assembly 32 will "push" the sleeve 40 downwardly until the lower edge 48 of the sleeve 40 contacts the shoulder 50 and limits the downward movement of the sleeve with respect to the mandrel 30. However, the downward sliding movement of the sleeve 40 into engagement with shoulder 50, at the enlarged surface 35 interface with mandrel 30, is sufficient to permit the sleeve upper edge 44 to clear the mandrel transverse port and permitting fluid flow through port 52 and axial bore 56. The fluid flow-through axial bore 56 will equalize the pressure across the cup assembly 32 and permit unhindered removal of the tool 16(16') and apparatus 14 in a direction opposite to that shown by arrows 17(17').

In a second alternative technique, the tool string 16(16') and apparatus 14 may be raised by the wireline cable 18 at a rate (fps) sufficient to cause a preselected change (increase) in the pressure acting on cup assembly 32 in the direction shown by arrows 17(17') to create sufficient forces acting on cup assembly 32 to exceed the shear resistance of the shear pins disposed in aligned apertures 46/46' of the sleeve and mandrel, respectively, and shear the pins to release the sleeve 40. Sleeve 40 will move downwardly in response to the forces acting on cup assembly 32 to open transverse port 52 in the same manner as above described. In the position shown in FIG. 3B, the pressure will equalize through the transverse port 52 and the axial bore 56 from above the cup assembly 32 and exit the lower end 36 of the mandrel as shown by the arrows. With port 52 open, the apparatus may be rapidly moved from the last position in the tubular member by means of wireline cable 18, since the pressure will be equalized through the open port 52 and mandrel axial bore 56 and will prevent any pressure differential (ΔP) building up over the cup assembly as previously described. The apparatus 14 may be reused by inserting new shear pins in the aligned sleeve/mandrel apertures 46/46' to position the sleeve to close the transverse port 52.

Figure 4A:
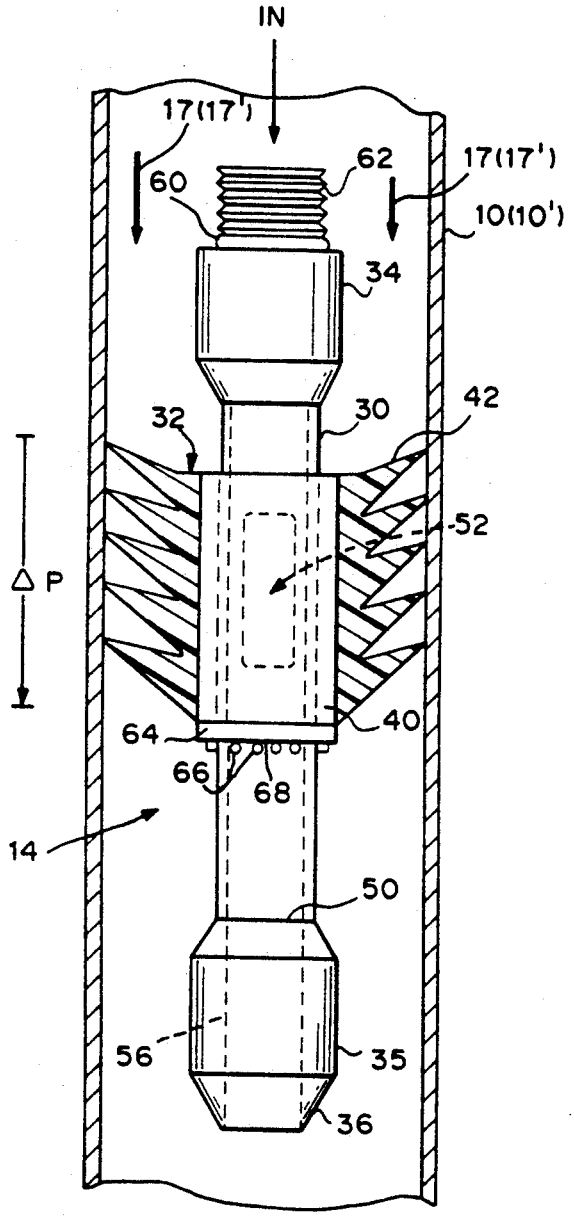
FIG. 4A is a detailed side view, partly in cross-section, showing a variation of the first embodiment of the propulsion apparatus disposed in a tubular member with the sleeve and a shear ring held by shear pins, closing the axial bore through the mandrel to fluid communication.
Figure 4B:
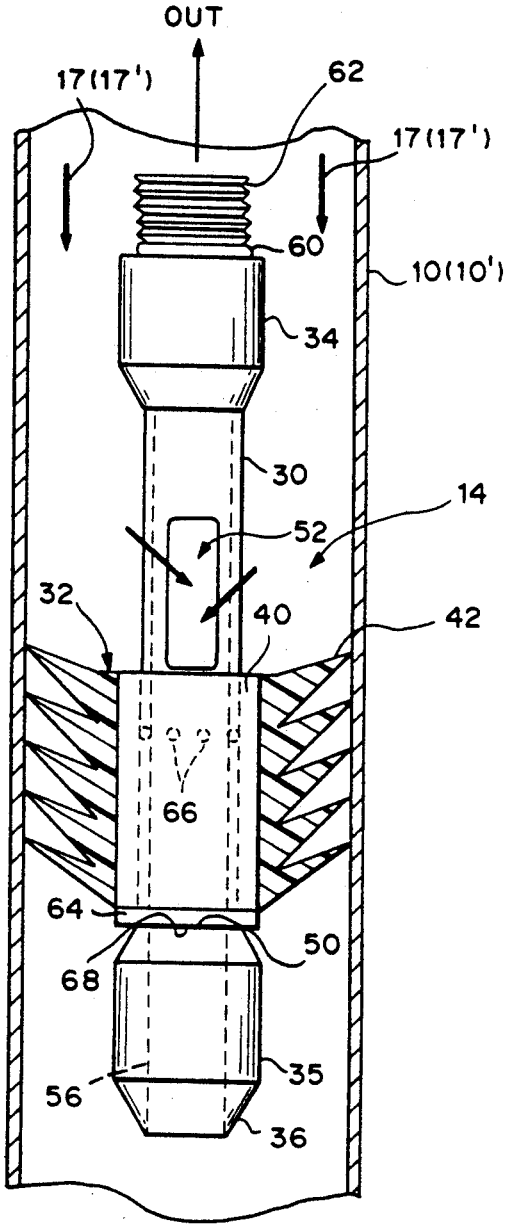
FIG. 4B is a detailed side view, partly in cross-section, showing the variation in the second embodiment of the propulsion apparatus disclosed in FIG. 4A with the shear pins having been sheared and the sleeve and shear ring displaced on the mandrel to open the axial bore through the mandrel to fluid communication.

Referring now to FIGS. 1, 2, 4A and 4B, a variation of the first embodiment of the apparatus 14 disclosed in FIGS. 3A and 3B will now be described. The variation of the apparatus 14 and its operation as shown in FIGS. 4A and 4B are virtually identical to the embodiment of FIGS. 3A and 3B except for the arrangement of the shear pins and their operation and positioning the sleeve 40 with respect to the mandrel 30. Accordingly, only the changes in the apparatus 14 as are disclosed in FIGS. 4A and 4B will be described in detail, since all other aspects of the construction and operation of apparatus 14 is identical to that hereinabove described.

As shown in FIG. 4B, the sleeve 40 carrying the attached piston means or cup assembly 32, has attached to its lower end a metal shear ring 64 that is supported by a plurality of circumferentially spaced and radially projecting shear pins 66 disposed in corresponding apertures (not shown) in the mandrel 30. In this configuration, the sleeve 40 closes the transverse port 52 in the identical manner as was hereinabove described with relation to FIG. 3A. The tool 16(16') can be positioned within the tubular member 10(10') in the same manner as previously described.

Similarly, the sleeve 40 can be released from its first selected position with respect to mandrel 30 closing the transverse port 52 in the same manner as above described with relation to FIGS. 3A and 3B, i.e., by a preselected change in the pressure acting on the cup assembly 32 (an increase in pressure in this embodiment) created in the same manner as previously described. The change in pressure (increase) causes an increase in the pressure differential (ΔP) across the cup assembly 32 and when the forces acting on the cup assembly 32 and translated to the sleeve shear ring 64 exceed the shearing resistance of the shear pins 66, the shear ring shears pins 66 and permits the sleeve 40 to move with respect to mandrel 30 and open the mandrel transverse port 52 in the same manner as hereinabove previously described. The sleeve 40 will slide down on the tubular mandrel 30 until the lower edge 68 engages the shoulder 50 in the same manner as above described for the embodiment shown in FIGS. 3A and 3B. The construction, operation and use of the first embodiment variation as shown in FIGS. 4A and 4B is the same as the embodiment described above with relation to FIGS. 3A and 3B, and no further description is necessary.

Figure 5:
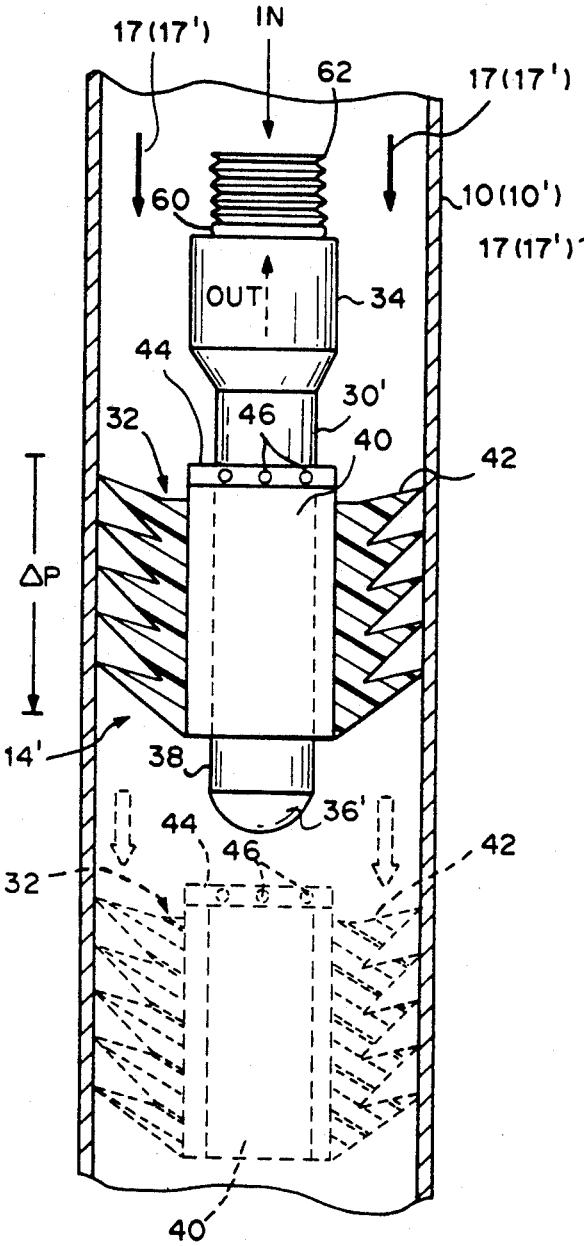
FIG. 5 is a detailed side view, partly in cross-section, showing a second embodiment of the propulsion apparatus disposed in a tubular member with the sleeve held in place with regard to the mandrel by shear pins, and with the sleeve shown disengaged from the lower end of the mandrel by the dotted lines.

Referring now to FIGS. 1, 2 and 5, a second embodiment of the propulsion apparatus 14' will now be described in detail. As hereinabove previously described, the propulsion apparatus 14' comprises a top sub portion 34 having a male threaded connector 62 and a sealing O-ring 60, and an elongated tubular mandrel section 30', depending from the top sub portion 34. A cylindrical sleeve 40 is coaxially disposed over the tubular mandrel 30' and is sized for a close sliding fit over the mandrel. The top end of the sleeve 40 carries therein a plurality of circumferentially spaced and radially disposed apertures 46 that are aligned with a matching set of circumferentially spaced and radially disposed apertures 46' in the mandrel. In the embodiment shown, shear pins or screws (not shown for simplicity) would be inserted in the aligned circumferentially disposed apertures 46/46' to provide some total predetermined shearing resistance and to position and retain the sleeve 40 in a first position as shown. The tubular mandrel 30' has a uniform diameter continuing to the lower free end 36'.

A cup assembly 32 that also functions as piston means 32 is mounted circumferentially of sleeve 40. The cup assembly 32 may comprise one or more fin elements 42 that project radially and circumferentially from the sleeve 40 and substantially close the annular space between the sleeve and the inner surface of the tubular member 10(10'). The projecting fin element(s) 42 of the cup assembly act as piston means 32 that cooperates with the sleeve 40 and the tubular casing walls 10(10') for translating fluid pressure applied at 17(17'), and developed as a differential pressure (ΔP) across the cup assembly 32, into propelling forces acting on the cup assembly/piston means 32 and transferred to the attached sleeve 40. The propelling forces are controlled by the pressurized fluid forces exerted at 17(17') by the pump 26 for achieving a preselected force magnitude and generally act coaxially to the apparatus 14 and cup assembly/piston means 32 in the direction of the arrows 17(17') just as hereinabove described for the embodiments disclosed in FIGS. 3A, 3B, 4A and 4B.

In operation, the propulsion apparatus 14 is attached by the threaded end 62 of the top sub 34 to the lower box end 13 of the tool 16(16') (see FIGS. 1 and 2) and the tool and propulsion apparatus are inserted into the tubular member 10(10'). The sleeve 40 and cup assembly/piston means 32 has been positioned as shown in FIG. 5 with the sleeve 40 positioned generally centrally of the mandrel 30'. A plurality of shear pins (not shown for simplicity) have been inserted into the registering apertures 46 and 46' of the sleeve and mandrel, respectively, to position and retain the sleeve in the first selected position shown in FIG. 5.

The pressurized fluid introduced in the casing/pipe 10(10') acts in the direction of the arrows 17(17') to develop a fluid pressure differential "ΔP" across the cup assembly/piston means 32 in the direction shown. The developed pressure differential ΔP is translated into forces having a preselected first magnitude and acting generally coaxially on the fin elements 42 to apply propelling forces to the cup assembly/piston means 32 in the direction of the arrows 17(17') in order to exert the propelling forces on the attached sleeve 40. As long as the propelling forces created by the differential pressure ΔP are of a first magnitude that is less than the combined preselected shear resistance forces of the shear pins disposed in the registering apertures 46 and 46', the shear pins will hold the sleeve 40 in the first selected position as shown in FIG. 5 and will transfer the propelling forces acting on the cup assembly and sleeve to the mandrel 30' and the tool 16(16'). Accordingly, the propulsion apparatus 14' will respond to the differential pressure ΔP and translate the fluid differential pressure into coaxial forces acting to push the piston means 32 through the tubular member 10(10') in the direction of reduced fluid pressure, thus acting as a locomotive to "pull" the selected tool string 16(16') through the tubular member to a desired location as hereinabove described.

When the apparatus 14' and attached tool string 16(16') has been properly positioned, the logging sequence using the tool 16(16') can begin. As above described, the logging tool 16(16') may be raised with the piston means (cup assembly) 32 in the position shown in FIG. 5, since there is not necessarily a "seal" between the tips of fins 42 and the inner surface of the walls of the tubular member 10(10'). As long as the tool 16(16') is raised at a rate that permits sufficient "flow" or "leakage" of the fluid past the tips of fins 42 and does not generate sufficient forces to create a ΔP that will exceed the shearing resistance of the shear pins disposed in aligned apertures 46/46', the sleeve 40 will remain in the selected first position on the mandrel 30' as shown in FIG. 5.

To release the sleeve 40 to achieve the correct logging speed of tool 16(16'), or to rapidly remove the tool 16(16') and the apparatus 14', then the sleeve 40 can be actuated to the position shown in the dotted lines in FIG. 5. The sleeve 40 can be released with respect to the mandrel 30' as shown in FIG. 5 by the same techniques above described for the prior embodiments.

The fluid pressure in the tubular member 10(10') as reflected by arrows 17(17') may be changed by a preselected magnitude (in this embodiment, "raised") to create a ΔP acting across the cup assembly that creates forces sufficient to exceed the shearing forces of the shear pins disposed in aligned apertures 46/46', thus shearing the pins and releasing sleeve 40. The forces at 17(17') acting on the cup assembly 32 will "push" the sleeve 40 downwardly until the sleeve 40 disengages from the lower free end 36' of the tubular mandrel 30' as shown by the dotted lines and falls to the bottom of the borehole or other tubular member. Fluid flow is thus permitted the apparatus 14' and allows unhindered removal of the tool 16(16') and top sub 34 and mandrel 32' in a direction opposite to that shown by arrows 17(17').

In another technique, the tool string 16(16') and apparatus 14' may be raised by the wireline cable 18 at a rate (fps) sufficient to cause a preselected change (increase) in the pressure acting on cup assembly 32 in the direction shown by arrows 17(17') to create sufficient forces acting on cup assembly 32 to exceed the shear resistance of the shear pins disposed in aligned apertures 6/46' of the sleeve and mandrel, respectively, and shear the pins to release the sleeve 40. Sleeve 40 will slide downwardly in response to the forces acting on cup assembly 32 and disengage from the end 36' of mandrel 30' in the same manner as above described.

Figure 6:
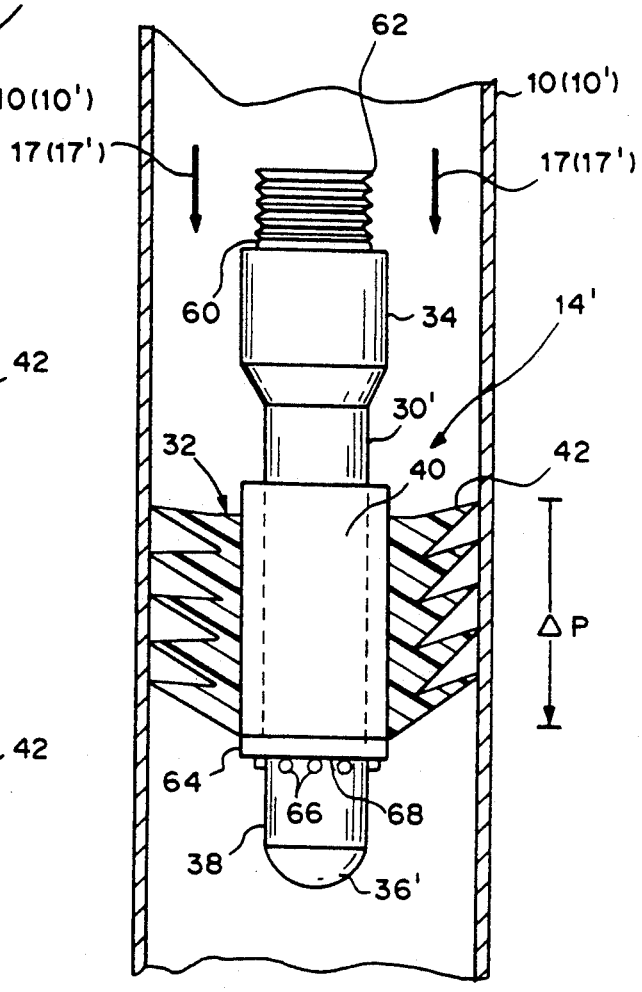
FIG. 6 is a detailed side view, partly in cross-section, showing a variation of the embodiment of the propulsion apparatus disposed in a tubular member as shown in FIG. 5 with the sleeve and a shear ring supported by shear pins.

Referring now to FIGS. 1, 2, 5 and 6, a variation of the second embodiment of the apparatus 14' disclosed in FIG. 6 is shown. The variation of the apparatus 14' and its operation as shown in FIG. 6 is virtually identical to the embodiment of FIG. 5 except for the arrangement of the shear pins and their operation and positioning the sleeve 40 with respect to the mandrel 30'. Accordingly, only the changes in the apparatus 14' as are disclosed in FIG. 6 will be described in detail, since all other aspects of the construction and operation of apparatus 14 is identical to that hereinabove described.

As shown in FIG. 6 the sleeve 40 carrying the attached piston means or cup assembly 32, has attached to its lower end a metal shear ring 64 that is supported by a plurality of circumferentially spaced and radially projecting shear pins 66 disposed in corresponding apertures (not shown) in the mandrel 30'. In this configuration, the sleeve 40 is positioned in a selected first position in the identical manner as was hereinabove described with relation to FIG. 5. The tool 16(16') can be positioned within the tubular member 10(10') in the same manner as previously described.

Similarly, the sleeve 40 can be released from its first selected position with respect to mandrel 30' in the same manner as above described with relation to FIG. 5, i.e., by a preselected change in the fluid pressure acting on the cup assembly 32 (an increase in pressure in this embodiment) created in the same manner as previously described. The change in fluid pressure (increase) causes an increase in the pressure differential (ΔP) across the cup assembly 32 and when the fluid forces acting on the cup assembly 32 and translated to the sleeve shear ring 64 exceed the shearing resistance of the shear pins 66, the shear ring shears pins 66 and permits the sleeve 40 to move with respect to mandrel 30 and to slide off and disengage from the free end 36' in the same manner as hereinabove previously described in FIG. 5. The construction, operation and use of the second embodiment variation as shown in FIG. 6 is the same as the embodiment described above with relation to FIG. 5, and no further description is therefore necessary.

Figure 7A:
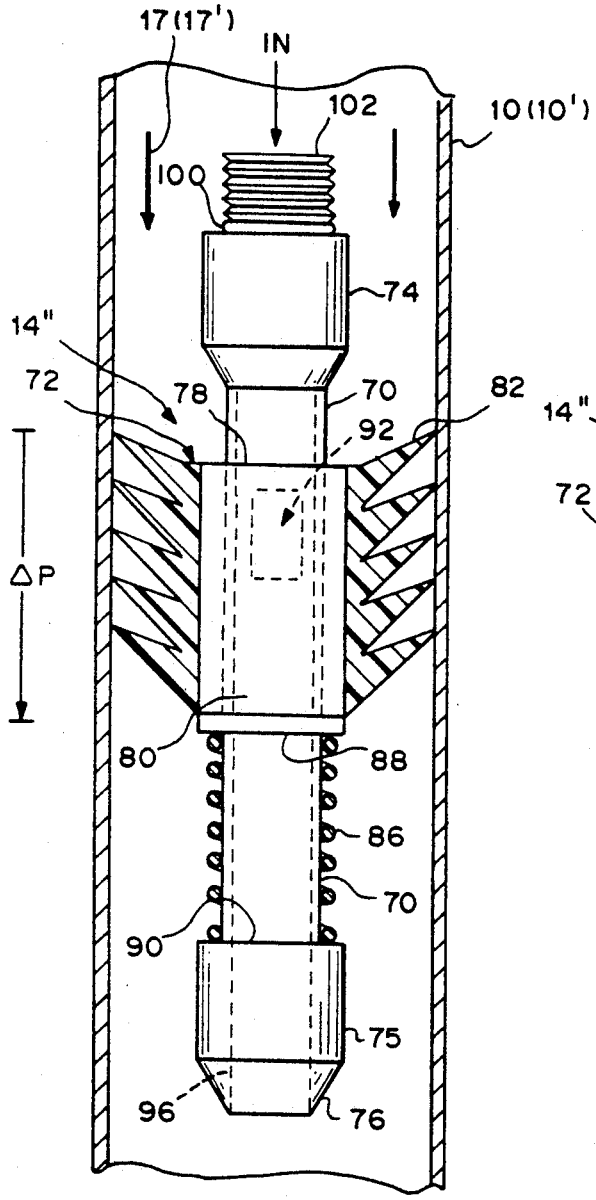
FIG. 7A is a detailed side view, partly in cross-section, showing the third embodiment of the propelling apparatus disclosed in FIG. 7A with the sleeve displaced by the biasing forces of the compression spring exceeding the fluid propelling forces acting thereon to close the mandrel transverse port to fluid communication.
Figure 7B:
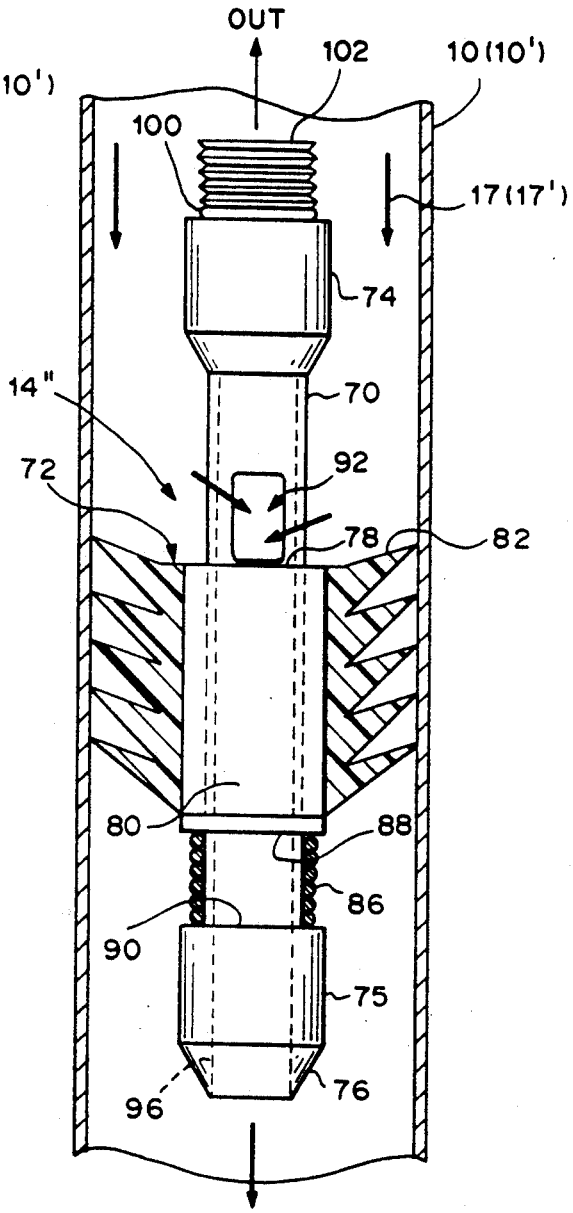
FIG. 7B is a detailed side view, partly in cross-section, showing a third embodiment of the propulsion apparatus disposed in a tubular member with the sleeve compressed against a counterbiasing compression spring under the fluid propelling forces to open the mandrel transverse port to fluid communication.

A third embodiment of apparatus 14" is shown in FIGS. 7A and 7B. Similar to the prior embodiments previously described, the propulsion apparatus 14" comprises a top sub portion 74 having a male connector 102 and a sealing O-ring 100 for mating with the free box end of the selected tool or tool combination 16(16') (not shown). An elongated tubular mandrel section 70 depends from the top sub portion 74 and has an interior axial bore 96. A transverse port 92 is provided for communication with the axial bore 96. A cylindrical sleeve 80 is coaxially disposed over the tubular mandrel 70 and is sized for a close sliding fit. The lower free end 76 of the mandrel 70 has an enlarged portion 75 that provides a circumferential shoulder at 90.

A cup assembly 72 that also functions as piston means 72 is mounted circumferentially of sleeve 80. The cup assembly 72 may comprise one or more fin elements 82 that project radially and circumferentially from the sleeve 80 and substantially reduce the annular space between the sleeve and the inner surface of the tubular member 10(10'). The projecting fin element(s) 82 of the cup assembly act as piston means 72 that cooperate with the sleeve 80 and the tubular casing walls 10(10') for translating fluid pressure applied at 17(17'), and developed as a differential pressure (ΔP) across the cup assembly 72, into propelling forces acting on the cup assembly/piston means 72 and transferred to the attached sleeve 80. The propelling forces may be controlled by the pressurized fluid forces exerted at 17(17') by the pump 26 (see FIG. 1) for achieving a preselected force magnitude and generally act coaxially to the apparatus 14" and cup assembly/piston means 72 in the direction of the arrows 17(17').

A compression coil spring 86 is disposed over the tubular mandrel 70 between the shoulder 90, adjacent the lower end 76 of apparatus 14", and the lower edge 88 of the sleeve 80. The coil spring 86 provides a sleeve positioning or biasing means that cooperates with the sleeve and mandrel 70 for exerting preselected biasing forces acting upwardly against the edge 88 of sleeve 80. When the fluid propelling forces, as hereinabove previously described, are less than the biasing forces exerted against sleeve 80 by the biasing spring 86, the sleeve 80 will be positioned as shown in FIG. 7A, thereby closing mandrel transverse port 92 and prohibiting fluid communication from the interior of the tubular member 10(10') through port 92 and axial bore 96. However, when the propelling forces, as hereinabove described acting on the cup assembly 72, exceed the biasing forces exerted by spring 86, the sleeve 80 will be forced to slide downwardly against the compression spring force until the upper edge 78 of sleeve 80 uncovers the mandrel transverse port 92, as shown in FIG. 7B, which effectively permits fluid communication through port 92 and the mandrel axial bore 96.

In operation, the propulsion apparatus 14" is attached by the mating end 102 of the top sub 74 to the lower box end 13 of the tool 16"(16') (see FIGS. 1 and 2) and the tool and propulsion apparatus are inserted into the tubular member 10(10'). The sleeve 80 and cup assembly/-piston means 72 are initially positioned as shown in FIG. 7A with the sleeve closing transverse mandrel port 92. Pressurized fluid is introduced in the casing-/pipe 10(10') and acts in the direction of the arrows 17(17') to develop a fluid pressure differential "ΔP" across the cup assembly/piston means 72 in the direction shown. The developed pressure differential ΔP is translated into forces having a preselected first magnitude and acting generally coaxially on the fin elements 82 to apply propelling forces to the cup assembly/piston means 72 in the direction of the arrows 17(17') that are insufficient to overcome the biasing forces exerted in the opposite direction by spring 86. As long as the propelling forces created by the differential pressure ΔP are of a first magnitude that is less than the oppositely directed forces of the compression coil spring 86, the compression spring biasing force will hold the sleeve 80 in the first selected position closing the mandrel transverse port 92 as shown in FIG. 7A and will transfer the propelling forces acting on the cup assembly and sleeve to the mandrel 70 and the tool 16(16') as transmitted through spring 86 and shoulder 90. Accordingly, the propulsion apparatus 14" will respond to the differential pressure ΔP and translate the fluid differential pressure into coaxial forces acting to push the piston means 72 through the tubular member 10(10') in the direction of reduced fluid pressure, thus acting as a locomotive to "pull" the selected tool string 16(16') through the tubular member to a desired location. For the same reasons as above described, it is not necessary that the radial tips of the fin elements 82 of the cup assembly 72 actually "touch" and/or form a "seal" win the interior of the walls of casing/pipe 10(10').

When the apparatus 14" and attached tool string 16(16') has been properly positioned, logging measurements can be taken. Typically, logging measurements or other services are performed as the tool 16(16') is raised. Logging speeds are relatively slow and usually the logging tool 16(16') may be raised with the piston means (cup assembly) 72 in the position shown in FIG. 7A against the fluid pressure exerted within the tubing 10(10') in the direction of the arrows 17(17'), since as above described, there is not necessarily a "seal" between the tips of fins 82 and the inner surface of the walls of the tubular member 10(10'). As long as the tool 16(16') is raised at a rate that permits sufficient "flow" or "leakage" of the fluid past the tips of fins 82 and continues to exert forces creating a ΔP that is less than the biasing forces of the spring 86, the sleeve 80 will remain in position on the mandrel 70 closing the port 92 as shown in FIG. 7A.

However, if it is necessary to release the sleeve 80 to achieve the correct logging speed of tool 16(16'), or after logging it is desired to be able to rapidly remove the tool 16(16') and the apparatus 14", then the sleeve 80 can be actuated to the position shown in FIG. 7B. The fluid pressure in the tubular member 10(10') as reflected by arrows 17(17') may be changed by a preselected magnitude (in this embodiment "lowered") to create a ΔP acting across the cup assembly that creates forces that exceed the biasing force of the spring 86, thus permitting the spring to compress and move downwardly to permit the upper edge 78 of sleeve 80 to clear the port 92 and permit fluid flow through port 92 and the mandrel axial bore 96. The fluid flow through axial bore 96 will equalize the fluid pressure across the cup assembly 72 and permit upward movement of the tool 16(16') and apparatus 14" in a direction opposite to that shown by arrows 17(17') for removal from the tubular member 10(10').

One advantage of the third embodiment of the propulsion apparatus 14" shown in FIGS. 7A an 7B is that it may be used multiple times to position a tool 16(16') in a tubular member 10(10') without withdrawing the apparatus from the member to be manually reset or refurbished as above disclosed in regard to FIGS. 3A, 3B, 4A, 4B, 5 and 6. In order to reposition the tool string 16(16'), all that is necessary is that the pressure within the tubular member 10(10') above apparatus 14" be controlled, as shown in the direction of arrows 17(17'), to a preselected magnitude that does not overcome the biasing force of the coil spring 86. With the spring forces greater than the fluid forces, the spring 86 will force the sleeve 80 upwardly to close the mandrel port 92 and permit transmission of propelling forces acting on the cup assembly 72 to the sleeve 80 and mandrel 70. Further logging or other intervention activities may again be pursued. The fluid forces acting at 17(17') within the tubular member 10(10') may then again be increased to exceed the spring biasing forces to exceed the propelling force and again allow sleeve 80 to be moved downwardly to the position shown in FIG. 7B that permits fluid flow through the mandrel transverse port 92 and axial bore 96 for the purposes hereinabove described.

Figure 8:
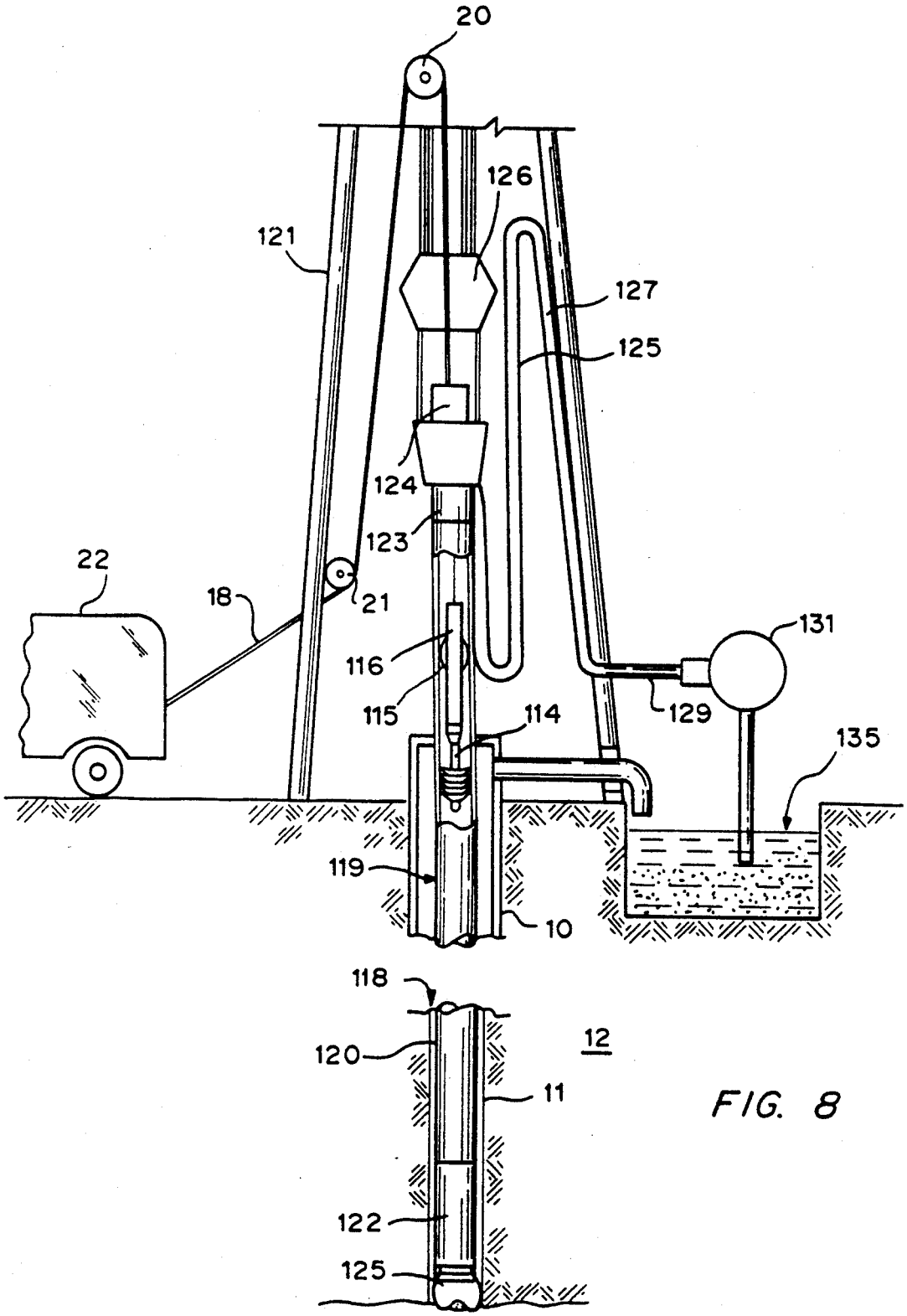
FIG. 8 is a view of a typical layout of a drilling rig showing a drill string and drill bit for drilling a borehole in which another embodiment of the propulsion apparatus may be utilized to propel a mud motor steering tool into the drill string.

FIG. 8 shows a basic oil or gas well drilling arrangement for drilling a borehole 11 in formation 12 using a drilling mud actuated motor and in which a portion of the borehole has been lined with casing 10. A drill string 119 comprising tubular drill string sections (not shown) such as drill pipe and drill collars is disposed in the borehole and has a lower end comprising a tubular drill member 120 that is connected to a conventional mud motor 122 that in turn drives a rotary drill bit 125 that cuts through the formation to drill the borehole 11. The upper end of drill string 119 is connected to a swivel 123 that is suspended in a conventional manner from a drilling rig structure 121 using a block 126. Drilling fluid for driving the mud motor 122, which is a positive displacement drilling motor actuated by hydraulic pressure caused by the circulation of drilling fluid or "mud"

therethrough and for lubricating the drill bit 125, is pumped from a pit or tank 135 by pump 131 through piping 129 and 127 to a flexible hose 125 and into the interior of the tubular drill string 119. The mud passes down through the drill string 119 and into the lower drill pipe member 120 and then is applied to the mud motor 122 where it exits into the borehole through the drill bit 125 and provides lubrication for the cutting surfaces of the bit.

The mud is circulated under pressure up through the annulus 118 between the drill string 119 and the borehole 11 and casing 10 back into the pit or tank 135 where it is recirculated again by pump 131 into the borehole in a conventional manner. In some cases where the borehole is to be directionally slanted or deviated from the vertical (a deviated borehole), a steering tool 116 may be lowered into the drill string to control the drilling direction of the motor for deviating boreholes from the vertical. The steering tool 116 is typically positioned above the mud motor 122 in the lower drill string tubular member 120. The drilling fluid flow through member 120 must be interconnected through the end of the tubular member 120 to the input of the mud motor 122.

The steering tool 116 is conventionally lowered into the drill string 119 by a wireline cable 18 that passes through a special swivel and pack off device 124 and over sheaves 20 and 21 to a drum (not shown) mounted in a station truck 22. The steering tool 116 is supported within tubular drill string 119 by conventional centralizers 115. However, in highly deviated boreholes, or in horizontal boreholes, a wireline will not function to "lower" the steering tool into the drill string 119. The use of the present invention is tailor-made for such an application, and another embodiment of the propulsion apparatus 114 is shown attached to the lower end of the steering tool 116 for propelling the combination of apparatus 114 and tool 116 through the drill string 119 and into the lower tubular member 120 for properly positioning and coupling the steering tool in place above the mud motor 122.

Figure 9:
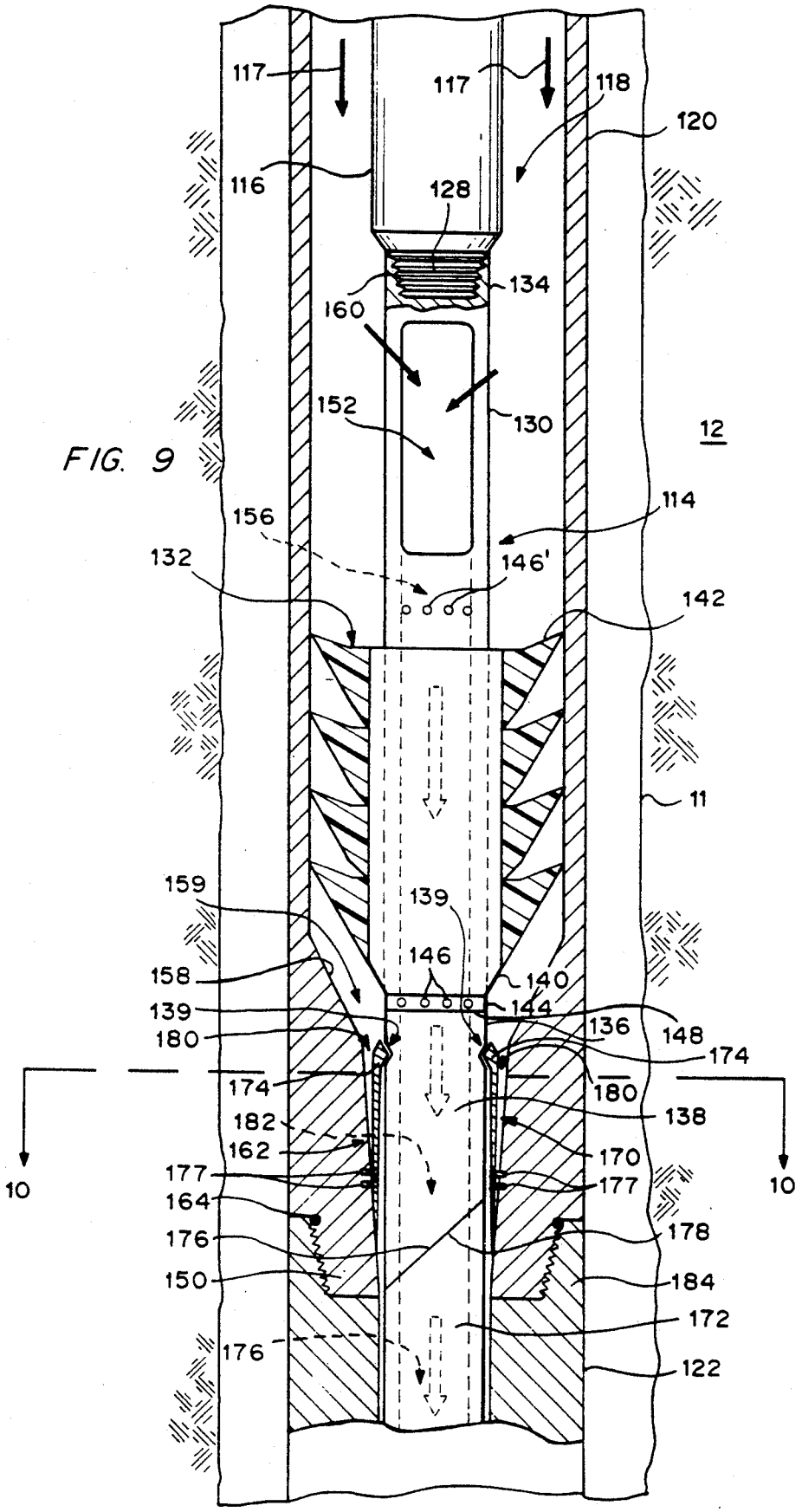
FIG. 9 is detailed side view, partly in cross-section, showing another embodiment of the propulsion apparatus disposed in a tubular drill pipe or drill collar section and attached to a mud motor steering tool for latching to the last pipe section for communicating fluid to the mud motor.
Figure 10:
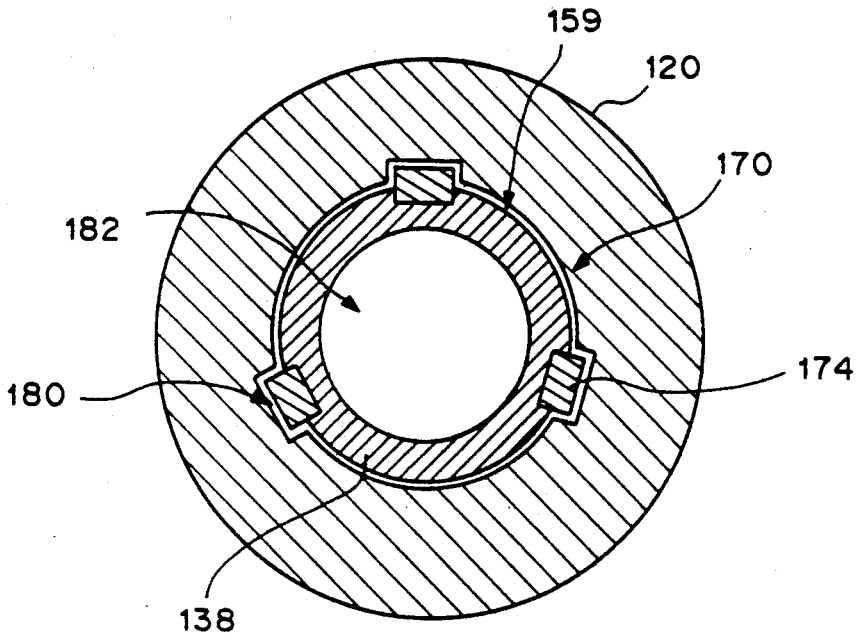
FIG. 10 is a horizontal cross-sectional view of the coupling means disposed in the final tubular drill string member for latching the propulsion apparatus in place, taken along lines 10-10 of FIG. 9.

FIGS. 9 and 10 illustrate yet another embodiment of the propulsion apparatus 114 that can be used to properly position and align a steering tool 116 within a tubular drill string member 120 and establish a means of fluid intercommunication between the tubular member and the inlet port to the mud motor 122. As shown, the lower male threaded end 150 of tubular member 120 is threaded into the female box end 184 of the upper end of the mud motor 122. The lower end of the tubular member 120 is closed with a bore 159 therethrough having a conical throat 158 interconnecting the interior of the tubular member 120 and the bore 159. Disposed in the bore 159 is a coupling means 170 for latching engagement of the lower end 136 of the propulsion apparatus 114 to the lower end of member 120 as will be hereinafter further described. The bore 159 in the closed end of member 120 communicates through the axial bore 182 of a guide element 138 disposed in the housinq of the mud motor 122 and axially aligned with bore 159 that directs pressurized drilling fluid into the interior (not shown) of the mud motor for operating the motor in a conventional manner.

The propulsion apparatus 114 comprises a top sub portion 134 shown having a connector 160 for mating with the steering tool 116 connector 128. An elongated tubular mandrel section 130 depends from the top sub portion 134 and has an interior axial bore 156. A transverse port 152 is provided for communication with the axial bore 156. A cylindrical sleeve 140 is coaxially disposed over the tubular mandrel 130 and is sized for a close sliding fit over the mandrel. The lower end 144 of the sleeve 140 carries therein a plurality of circumferentially spaced and radially disposed apertures 146 that are aligned with a matching set of circumferentially spaced and radially disposed apertures 146' in the mandrel. In the embodiment shown, shear pins or screws (not shown for simplicity) would be inserted in the aligned circumferentially disposed apertures 146/146' to provide a total predetermined shearing resistance and to position and retain the sleeve 140 in a first position similar to that shown in FIG. 3A or 4A for closing the transverse port 152 and substantially prohibiting fluid communication from the interior of the tubular member 120 through the transverse port 152 and axial bore 156 for purposes to be hereinafter described in greater detail. The lower end 136 of the mandrel 130 has an extending tubular probe member 138 having an axial bore 182 communicating with the axial bore 156. Spaced from the lower free probe end 138 of the mandrel is a circumferential groove 135 disposed in the mandrel end 136. The circumferential groove 135 is a latching groove that cooperates with the coupling means 170 as will hereinafter be further explained.

A cup assembly 132 (piston means 132) is mounted circumferentially of sleeve 140. The cup assembly 132 may comprise one or more fin elements 142 that project radially and circumferentially from the sleeve 140 and substantially reduce the annular space between the sleeve and the inner surface of the tubular member 120. The projecting fin element(s) 142 of the cup assembly act as piston means 132 that cooperates with the sleeve 140 and the tubular casing walls 120 for translating fluid pressure applied downwardly as shown by arrows 117(117'), and developed as a differential pressure ($\Delta P$) across the cup assembly 132 as hereinabove earlier explained, into propelling forces acting on the cup assembly/piston means 132 and transferred to the attached sleeve 140. The propelling forces are controlled by the pressurized fluid forces exerted at 117(117') by the pump 131 for achieving a preselected force magnitude and generally act coaxially to the apparatus 114 and cup assembly/piston means 132 in the direction of the arrows 117(117').

In operation, the propulsion apparatus 114 is attached by the connector 160 of the top sub 134 to the lower end 128 of the steering tool 116 and the tool and propulsion apparatus are inserted into the tubular member 119(120). The sleeve 140 and cup assembly/piston means 132 has been positioned with the sleeve 140 covering the transverse mandrel port 152 in order to substantially prohibit fluid flow from the interior of the tubular casing/pipe 120 through the port 152 and the axial bore 156 disposed in mandrel 130 and communicating with the free probe end 138 thereof, in the same manner as previously described for the prior embodiments shown in FIGS. 3A and 4A. A plurality of shear pins (not shown for simplicity) are inserted into the registering apertures 146 and 146' of the sleeve and mandrel, respectively, to position and retain the sleeve in the first position closing the mandrel transverse port 152 as above described.

The pressurized fluid introduced in the casing/pipe 120 acts in the direction of the arrows 117(117') to develop a fluid pressure differential "$\Delta P$" across the cup assembly/piston means 132 in the direction shown in the prior embodiments. The developed pressure differential is translated into forces having a preselected first magnitude and acting generally coaxially on the fin elements 142 to apply propelling forces to the cup assembly/piston means 132 in the direction of the arrows 117(117') in order to exert the propelling forces on the attached sleeve 140. As long as the propelling forces created by the differential pressure are of a first magnitude that is less than the combined preselected shear resistance forces of the shear pins disposed in the registering apertures 146 and 146', the shear pins will hold the sleeve 140 in the first selected position closing the mandrel transverse port 152 and will transfer the propelling forces acting on the cup assembly 132 and sleeve to the mandrel 130 and the steering tool 116. Accordingly, the propulsion apparatus 114 will respond to the differential pressure and translate the fluid differential pressure into coaxial forces acting to push the piston means 132 through the tubular member 120 in the direction of reduced fluid pressure, thus acting as a locomotive to "pull" the steering tool 116 through the tubular member to a desired location in a manner identical to that hereinabove described It is not necessary that the radial tips of the fin elements 142 of the cup assembly 132 actually "touch" and/or form a "seal" with the interior of the walls of casing/pipe 120 for the reasons hereinabove described.

The apparatus 114 is propelled through drill string 119 and into tubular member 120 until the free probe end 138 engages the coupling means 170. Coupling means 170 cooperates with the probe end 138 of apparatus 114 to engage and latch the probe end 138 into the closed end of tubular member 120 and provide fluid communication between axial bore 156 of mandrel 130 and the axial aperture or bore 159 disposed through the closed end and communicating with the bore 176 to the mud motor 122. Coupling means 170 includes a tubular guide member 172 having a slanted guide surface 176 that mates with a registering slanted guide surface 178 disposed on the tip of the tubular probe element 138, and latching means 162 disposed in the axial bore 159 in the closed end of tubular member 120.

The latching means 162 comprises a plurality of spring biased latching fingers 174 that are circumferentially spaced around the bore 159 and secured by screws 162. The upper end of the latching fingers are free to move outwardly into circumferentially spaced channels 180 disposed in the axial bore 159. As the probe end 138 enters the latching collet fingers 174, the guide surface 178 will engage the guide surface 176 of the guide member 172, thus forcing the apparatus 114 and steering tool 116 to rotate until the guide surfaces 176 and 178 match and mate. The mating of the guide surfaces 178 and 176 of the probe element 138 and the guide member 172, respectively, operate to properly "align" the gyrospically operated steering tool in a desired compass heading with the mud motor. The proper alignment and mating of the probe element 138 and the guide member 172 also aligns the latching groove 135 disposed in mandrel end 136 with the ends of the latch elements 174, thereby latching apparatus 114 to the closed end of tubular member 120 and aligning the axial bore 156 of the mandrel with the axial bore 182 disposed in guide element 172 for communicating wit the mud motor 122.

The fluid pressure in the tubular member 120 as reflected by arrows 117(117') may be changed by a preselected magnitude (in this embodiment, "raised") to create a differential pressure acting across the cup assembly 132 that creates forces sufficient to exceed the shearing forces of the shear pins disposed in aligned apertures 146/146', thus shearing the pins and releasing sleeve 140. The forces acting on the cup assembly 132 will "push" the sleeve 140 downwardly until the lower sleeve edge 148 contacts the throat 158 of the mandrel 130 and limits the downward movement of the sleeve with respect to the mandrel. The downward sliding movement of the sleeve is sufficient to permit the sleeve to clear the mandrel transverse port 152, thus permitting fluid flow through port 152, axial bores 156, 182 and 176 into the mud motor 122. Thus, the steering tool 116 can be properly positioned and aligned within a drill string tubular member 120 without pressurized drilling fluid actuating and driving the drill motor 122 until after the proper seating and alignment of the steering tool with the motor. The steering tool 116 and propulsion apparatus 114 may be removed by lifting up on the steering tool 116 and attached apparatus 114 to disengage the probe end 138 from the coupling means 172 and withdrawing the steering tool 116 and propulsion apparatus 114 for reuse.

Numerous variations and modifications may be made in the structure herein described without departing from the present invention. Accordingly, it should be clearly understood that the forms of the invention herein described and shown in the figures of the accompanying drawings are illustrative only and are not intended to limit the scope of the invention.

I claim:

1. Propulsion apparatus for attachment to a selected tool for propelling and positioning the tool in a tubular member in response to fluid pressure exerted within the tubular member, comprising:

a top sub portion adapted for connection to the mating end of the tool, an elongated tubular mandrel depending from said top sub portion and terminating in a lower free end, a tubular sleeve concentrically disposed around said elongated tubular mandrel and adapted for coaxial sliding movement with respect thereto, cup apparatus mounted on said sleeve and having at least one fin element projecting radially and circumferentially therefrom for substantially reducing all of the annular space between said sleeve and the inner surface of the tubular member and cooperating with said sleeve and the tubular member and fluid pressure exerted therein for translating fluid differential pressure developed across said at least one fin element of said cup apparatus into propelling forces having a preselected magnitude and cooperating therewith to apply said forces to said sleeve, sleeve retaining means cooperating with said sleeve and mandrel for positioning and retaining said sleeve in a first position with respect to said mandrel and cooperating with said propelling forces having said preselected magnitude and with said cup apparatus for transmitting said propelling forces cooperating with said cup apparatus and sleeve to said mandrel and the attached tool for propelling and positioning the tool to a selected location within the tubular member, wherein said cup apparatus and sleeve retaining means cooperatively respond to a preselected change in the fluid pressure differential acting across said cup apparatus for releasing said sleeve and permitting predetermined movement thereof from said first position with respect to said mandrel, said predetermined movement of said sleeve with respect to said mandrel allowing substantial equalization of the differential pressure developed across said cop apparatus.

2. The propulsion apparatus as described in claim 1, wherein said tubular mandrel further includes an inner axial bore disposed through at least a portion of the lower length thereof and communicating with said mandrel free end and a port transversely disposed through said tubular mandrel and spaced from said free end thereof for communicating with said inner axial bore.

3. The propulsion apparatus as described in claim 2, wherein said sleeve positioning means comprises a plurality of shear pins having a preselected shearing resistance exceeding said propelling forces first magnitude and radially disposed through registering circumferentially spaced apertures disposed in said tubular mandrel and sleeve for positioning and retaining said sleeve in said preselected position with respect to said mandrel and closing said transverse port disposed in said mandrel for substantially prohibiting fluid communication therethrough.

4. The propulsion apparatus as described in claim 3, wherein said preselected change in the fluid pressure differential acting across said cup assembly sleeve increases the propelling forces transmitted to said sleeve and said plurality of shear pins to exceed the shearing resistance thereof for releasing said sleeve for coaxial movement from said preselected position on said tubular mandrel and opening said mandrel transverse port for diverting fluid above said cup assembly through said mandrel transverse port and axial bore.

5. The propulsion apparatus as described in claim 2, wherein said sleeve positioning means comprises:

a shear ring coaxially disposed about the outer diameter of said tubular mandrel and attached to said sleeve, and a plurality of shear pins having a preselected shearing resistance exceeding said propelling forces first magnitude and circumferentially spaced and radially disposed in said tubular mandrel for engaging and supporting said shear ring and sleeve in said preselected position with respect to said mandrel and closing said transverse port disposed in said mandrel for substantially prohibiting fluid communication therethrough.

6. The propulsion apparatus as described in claim 5, wherein said preselected change in the fluid pressure differential acting across said cup assembly increases the propelling forces transmitted to said sleeve, shear ring and said plurality of shear pins to exceed the shearing resistance thereof for releasing said sleeve for coaxial movement from said preselected position on said tubular mandrel and opening said mandrel transverse port for diverting fluid above said cup assembly through said mandrel transverse port and axial bore.

7. The propulsion apparatus as described in claims 4 or 6, wherein said tubular mandrel includes a circumferential shoulder spaced from said free end for engaging and limiting the coaxial movement of said sleeve with respect to said tubular mandrel after said sleeve has opened said mandrel transverse port for fluid communication.

8. The propulsion apparatus as described in claim 2, wherein said sleeve positioning means comprises biasing means cooperating with said sleeve and tubular mandrel for exerting preselected biasing forces exceeding said fluid propelling forces acting on said cup assembly to position said sleeve with respect to said mandrel in said preselected position and closing said transverse port disposed in said mandrel for substantially prohibiting fluid communication therethrough.

9. The propulsion apparatus as described in claim 8, wherein said preselected change in the fluid pressure differential acting across said cup assembly sleeve increases the propelling forces transmitted to said sleeve for overcoming said preselected biasing force exerted by said biasing means and permitting coaxial movement of said sleeve from said preselected position with respect to said tubular mandrel and opening said mandrel transverse port for diverting fluid above said cup assembly through said mandrel transverse port and axial bore.

10. The propulsion apparatus as described in claim 9, wherein said biasing means comprises a compression spring adapted to engage said mandrel and said sleeve for applying preselected biasing forces to said sleeve.

11. The propulsion apparatus as described in claim 9, wherein said selected change in the fluid pressure differential acting on said cup assembly is introduced by increasing the pressure of the fluid pumped into the tubular member for increasing the differential pressure across said cup assembly and transmitted to said sleeve for exceeding said preselected biasing forces exerted by said biasing means.

12. The propulsion apparatus as described in claims 4 or 6 or 9, wherein said downhole tubular member includes a closed lower end with an axial bore therethrough, and wherein said apparatus further includes coupling means cooperating with said closed lower end of said tubular member and said axial bore and said lower free end of said mandrel for permitting latching engagement therebetween and permitting fluid communication between fluid in the tubular member above said cup assembly through said mandrel transverse port and mandrel axial bore and said closed end axial bore.

13. The propulsion apparatus as described in claim 12, wherein said mandrel lower free end includes a probe element projecting coaxially therefrom and having an axial bore therethrough for permitting fluid communication therethrough from said mandrel coaxial bore, and wherein said coupling means comprises engaging means disposed in the closed end of the downhole tubular member and cooperating with said mandrel probe element and said axial bore through said tubular member closed end for engaging and latching said probe element with respect to said tubular member closed end and permitting fluid communication through said mandrel transverse port and mandrel axial bore and said tubular member closed end axial bore.

14. The propulsion apparatus as described in claim 13, wherein said engaging means comprises:

a guide member mounted on said tubular member closed lower end for contacting said probe element and guiding said probe element into proper compass orientation therewith and into fluid communication with said axial bore in said tubular member closed end, and latching means cooperating with said tubular member closed end and said mandrel probe element for engaging said probe element and removably latching said probe element to said tubular member closed end in fluid communication with said axial bore therethrough.

15. The propulsion apparatus as described in claim 1, wherein said sleeve positioning means comprises a plurality of shear pins having a preselected shearing resistance exceeding said propelling force preselected magnitude and radially disposed through registering circumferentially spaced apertures disposed in said tubular mandrel and sleeve for positioning and retaining said sleeve in said preselected position with respect to said mandrel.

16. The propulsion apparatus as described in claim 15, wherein said preselected change in the fluid pressure differential acting across said cup assembly increases the propelling forces transmitted to said sleeve and said plurality of shear pins for exceeding the shearing resistance thereof and releasing said sleeve from said preselected position on said tubular mandrel for coaxial movement with respect thereto and disengagement from said mandrel lower free end.

17. The propulsion apparatus as described in claim 1, wherein said sleeve positioning means comprises:

a shear ring coaxially disposed about the outer diameter of said tubular mandrel and attached to said sleeve, and a plurality of shear pins having a preselected shearing resistance exceeding said propelling force preselected magnitude and circumferentially spaced and radially disposed in said tubular mandrel for engaging and supporting said shear ring and sleeve in said preselected position with respect to said mandrel.

18. The propulsion apparatus as described in claim 17, wherein said preselected change in the fluid pressure differential acting across said cup assembly increases the propelling forces transmitted to said sleeve, shear ring and said plurality of shear pins for exceeding the shearing resistance thereof and releasing said sleeve from said preselected position on said tubular mandrel for coaxial movement with respect thereto and disengagement from said mandrel lower free end.

19. The propulsion apparatus as described in claims 4 or 6 or 16 or 18, wherein said selected change in the fluid pressure differential acting on said cup assembly is introduced by pumping pressurized fluid into the tubular member above said cup assembly for creating a differential overpressure across said cup assembly and transmitted to said sleeve and plurality of shear pins sufficient to exceed the shearing resistance thereof.

20. The propulsion apparatus as described in claims 4 or 6 or 16 or 18, wherein said selected change in the fluid pressure differential acting on said cup assembly is introduced by raising the tool and attached propulsion apparatus through the fluid in the tubular member at a speed sufficient to create a differential overpressure across said cup assembly and transmitted to said sleeve and plurality of shear pins sufficient to exceed the shearing resistance thereof.

21. A method of propelling and positioning a selected tool in a tubular member in response to fluid pressure exerted within the tubular member, comprising the steps of:

attaching propulsion apparatus to the lower mating end of the downhole tool, said propulsion apparatus comprising:

a top sub portion adapted for connection to the mating end of the selected tool, an elongated tubular mandrel depending from said top sub portion and terminating in a lower free end, a tubular sleeve concentrically disposed around said elongated tubular mandrel and adapted for coaxial sliding movement with respect thereto, cup apparatus mounted on said sleeve and having at least one fin element projecting radially and circumferentially therefrom for substantially reducing all of the annular space between said sleeve and the inner surface of the tubular member and cooperating with said sleeve and the tubular member and fluid pressure exerted therein for translating fluid pressure developed in the tubular member into forces cooperating with said cup apparatus and acting as a propelling force applied to said sleeve, and sleeve retaining means cooperating with said sleeve and mandrel for positioning and retaining said sleeve in a first position with respect to said mandrel and cooperating with said fluid pressure for transmitting said fluid pressure forces cooperating with said cup apparatus and sleeve to said mandrel and the attached tool, increasing the pressure of the fluid in the tubular member above said cup apparatus for creating a fluid differential pressure thereacross that translates into coaxial propelling forces acting thereon, positioning the propulsion apparatus and attached tool to a desired position in the tubular member in response to said coaxial propelling forces acting on said cup apparatus, and creating a selected change in the fluid pressure differential across said cup apparatus for cooperating therewith and with said retaining means for releasing said sleeve from said mandrel and permitting predetermined coaxial sliding movement therebetween from said first position with respect to said mandrel, said predetermined movement of said sleeve with respect to said mandrel allowing substantial equalization of the differential pressure across said cup apparatus.

* * * * *